US011238788B2

(12) United States Patent
Qin et al.

(10) Patent No.: US 11,238,788 B2
(45) Date of Patent: Feb. 1, 2022

(54) OLED PANEL, DRIVING METHOD THEREOF AND DISPLAY DEVICE

(71) Applicant: BOE TECHNOLOGY GROUP CO., LTD., Beijing (CN)

(72) Inventors: Wei Qin, Beijing (CN); Kuanjun Peng, Beijing (CN); Chengchung Yang, Beijing (CN); Xiaolong Li, Beijing (CN); Zhiqiang Xu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/759,575

(22) PCT Filed: May 24, 2019

(86) PCT No.: PCT/CN2019/088287

§ 371 (c)(1),
(2) Date: Apr. 27, 2020

(87) PCT Pub. No.: WO2019/223775

PCT Pub. Date: Nov. 28, 2019

(65) Prior Publication Data

US 2020/0273399 A1 Aug. 27, 2020

(30) Foreign Application Priority Data

May 25, 2018 (CN) ..... 201810515308.8

(51) Int. Cl.
*G09G 3/3225* (2016.01)
*G09G 3/3266* (2016.01)

(52) U.S. Cl.
CPC ..... *G09G 3/3225* (2013.01); *G09G 3/3266* (2013.01); *G09G 2310/08* (2013.01); *G09G 2354/00* (2013.01)

(58) Field of Classification Search
None
See application file for complete search history.

(56) References Cited

U.S. PATENT DOCUMENTS

2016/0379554 A1* 12/2016 Zhang ..... G09G 3/3208 315/158
2017/0262095 A1* 9/2017 Reynolds ..... G06F 3/04166
(Continued)

FOREIGN PATENT DOCUMENTS

CN 101034532 A 9/2007
CN 101097691 A 1/2008
(Continued)

OTHER PUBLICATIONS

The First Office Action dated Jun. 21, 2019 corresponding to Chinese application No. 201810515308.8.
(Continued)

*Primary Examiner* — Stephen T. Reed
(74) *Attorney, Agent, or Firm* — Nath, Goldberg & Meyer; Joshua B. Goldberg

(57) ABSTRACT

The present disclosure provides an OLED panel, a driving method thereof and a display device. The OLED panel has pixel units arranged in rows and columns, and each including an OLED device. The OLED panel includes regions arranged in column direction, and each including at least one row of pixel units and a cathode layer, the OLED devices in each region share the cathode layer therein, and the cathode layer of each region is disconnected from the cathode layer of any other region. The OLED panel includes a cathode voltage supply circuit configured to output a cathode voltage including an operating level to the cathode layer. The cathode voltage supply circuit is configured to start outputting the operating level to the cathode layer of at least one
(Continued)

region at a time at least later than a time when all pixel units in the region receive a scan signal.

16 Claims, 3 Drawing Sheets

(56) References Cited

U.S. PATENT DOCUMENTS

| | | | | |
|---|---|---|---|---|
| 2018/0190197 | A1* | 7/2018 | Chang | G09G 3/3233 |
| 2019/0347981 | A1* | 11/2019 | Horowitz | G09G 3/02 |

FOREIGN PATENT DOCUMENTS

| | | | |
|---|---|---|---|
| CN | 101192372 | A | 6/2008 |
| CN | 101226290 | A | 7/2008 |
| CN | 101369408 | A | 2/2009 |
| CN | 102800288 | A | 11/2012 |
| CN | 104934459 | A | 9/2015 |
| CN | 105096817 | A | 11/2015 |
| CN | 107274854 | A | 10/2017 |
| CN | 107316612 | A | 11/2017 |
| CN | 107464517 | A | 12/2017 |
| CN | 108364608 | A | 8/2018 |
| KR | 1020080004000 | A | 1/2008 |

OTHER PUBLICATIONS

The Second Office Action dated Mar. 2, 2020 corresponding to Chinese application No. 201810515308.8.

* cited by examiner

OLED PANEL, DRIVING METHOD THEREOF AND DISPLAY DEVICE

CROSS-REFERENCE TO RELATED APPLICATION

This is a National Phase Application filed under 35 U.S.C. 371 as a national stage of PCT/CN2019/088287, filed May 24, 2019, an application claiming the benefit of Chinese Application No. 201810515308.8, filed May 25, 2018, the content of each of which is hereby incorporated by reference in its entirety.

TECHNICAL FIELD

The present disclosure belongs to the field of display technology, and particularly relates to an OLED panel, a driving method thereof and a display device.

BACKGROUND

MPRT (Motion Picture Response Time) is one of the key technical indicators of a display, and is used to describe the extent of dynamic picture smear. The MPRT of the display directly affects the extent of the smear when the display is displaying high speed pictures. The smaller the MPRT of the display, the less noticeable the smear effect of the display.

SUMMARY

Embodiments of the present disclosure provide an OLED panel having a plurality of pixel units arranged in rows and columns, and each pixel unit includes an OLED device. The OLED panel includes a plurality of regions arranged in a column direction, each region includes at least one row of pixel units and has a cathode layer, the OLED devices in each region share the cathode layer in the region, and the cathode layer of each region is disconnected from the cathode layer of any other region. The OLED panel includes a cathode voltage supply circuit configured to output a cathode voltage including an operating level to the cathode layer. The cathode voltage supply circuit is configured to start outputting the operating level to the cathode layer of at least one region at a time at least later than a time when all the pixel units in the region receive a scan signal.

In some embodiments, the OLED panel further includes: a dynamic portion determining circuit configured to determine a region of the OLED panel for displaying a dynamic portion of a dynamic picture; a rate determining circuit configured to determine a change rate of the dynamic portion; and an adjusting circuit configured to, in response to the rate determining circuit determining that the change rate of the dynamic portion is greater than a threshold, adjust at least one of: a length of time for which the cathode voltage supply circuit outputs the operating level to the cathode layer of the region for displaying the dynamic portion; and magnitudes of data signals output to the pixel units in the region for displaying the dynamic portion.

In some embodiments, the greater the determined change rate of the dynamic portion is, the longer the length of time for which the cathode voltage supply circuit outputs the operating level to the cathode layer of the region for displaying the dynamic portion is.

In some embodiments, the cathode voltage supply circuit is configured to start outputting the operating level to the cathode layer of each region at a time different from a time at which the cathode voltage supply circuit starts outputting the operating level to the cathode layer of any other region.

In some embodiments, the cathode voltage supply circuit is configured to output the operating level to the cathode layer of each region for a length of time different from a length of time for which the cathode voltage supply circuit outputs the operating level to the cathode layer of any other region.

In some embodiments, the cathode voltage supply circuit is configured to output the operating level to the cathode layer of a region for displaying more dynamic portions for a longer length of time.

In some embodiments, the cathode voltage supply circuit is configured to start outputting the operating level to the cathode layer of each region at a time at least later than a time when all the pixel units in the region receive the scan signal.

In some embodiments, a duty cycle of the cathode voltage is in a range of 10% to 80%.

The embodiments of the present disclosure further provide a method of driving the above OLED panel, including: during a display period of one frame of picture, sequentially supplying a scan signal to a plurality of rows of pixel units in a column direction, while separately supplying the cathode voltage including the operating level to the cathode layer of each of the plurality of regions by the cathode voltage supply circuit. The cathode voltage supply circuit starts outputting the operating level to the cathode layer of at least one region at a time at least later than a time when all the pixel units in the region receive the scan signal.

In some embodiments, the method further includes: determining, by the dynamic portion determining circuit, a region of the OLED panel for displaying a dynamic portion of a dynamic picture; determining, by the rate determining circuit, a change rate of the dynamic portion; and in response to the rate determining circuit determining that the change rate of the dynamic portion is greater than a threshold, adjusting, by the adjusting circuit, at least one of: a length of time for which the cathode voltage supply circuit outputs the operating level to the cathode layer of the region for displaying the dynamic portion; and magnitudes of data signals output to the pixel units in the region for displaying the dynamic portion.

In some embodiments, the greater the determined change rate of the dynamic portion is, the longer the length of time for which the cathode voltage supply circuit outputs the operating level to the cathode layer of the region for displaying the dynamic portion is.

In some embodiments, the cathode voltage supply circuit starts outputting the operating level to the cathode layer of each region at a time different from a time at which the cathode voltage supply circuit starts outputting the operating level to the cathode layer of any other region.

In some embodiments, the cathode voltage supply circuit outputs the operating level to the cathode layer of each region for a length of time different length from a length of time for which the cathode voltage supply circuit outputs the operating level to the cathode layer of any other region.

In some embodiments, the operating level is output to the cathode layer of a region for displaying more dynamic portions for a longer length of time.

In some embodiments, the cathode voltage supply circuit is configured to start outputting the operating level to the cathode layer of each region at a time at least later than a time when all the pixel units in the region receive the scan signal.

In some embodiments, a duty cycle of the cathode voltage is in a range of 10% to 80%.

Embodiments of the present disclosure further provide a display device including the above OLED panel.

In some embodiments, the display device includes a VR display device.

DETAILED DESCRIPTION

To enable those skilled in the art to better understand the technical solutions of the present disclosure, the present disclosure will be further described in detail below in conjunction with the accompanying drawings and the specific implementations.

The MPRT of a display screen is generally considered to be related to the following two aspects: 1) the refresh frequency of the display screen; 2) the switching time between different gray levels of the display screen. The picture smear phenomenon is generally alleviated by increasing the refresh rate of the display screen. According to the concept of the present disclosure, however, the smear phenomenon can be alleviated by, during a display period of each frame of picture, displaying the frame of picture in only a portion of the display period, and displaying a black picture (i.e., not displaying any picture) in the other portion of the display period. For example, a display screen with a refresh rate of 120 Hz can achieve the same smear effect as a display screen with a refresh rate of 240 Hz by displaying black after each frame of picture.

However, displaying a black picture during the display period of one frame of picture makes the time for actually displaying the frame of picture short, i.e., the refresh time for the frame of picture becomes short (for example, for a display panel with a refresh rate of 120 Hz, the refresh time of each frame of picture is 8.3 ms, but if a black picture is inserted, the display time of the black picture is 3 ms, the refresh time of each frame of picture is 5.3 ms), which causes a relatively large challenge to the signal charge and discharge time of the pixel switch, and as a result, a switch with a higher charge and discharge speed, e.g., a high mobility thin film transistor device, is needed.

Figure 1:
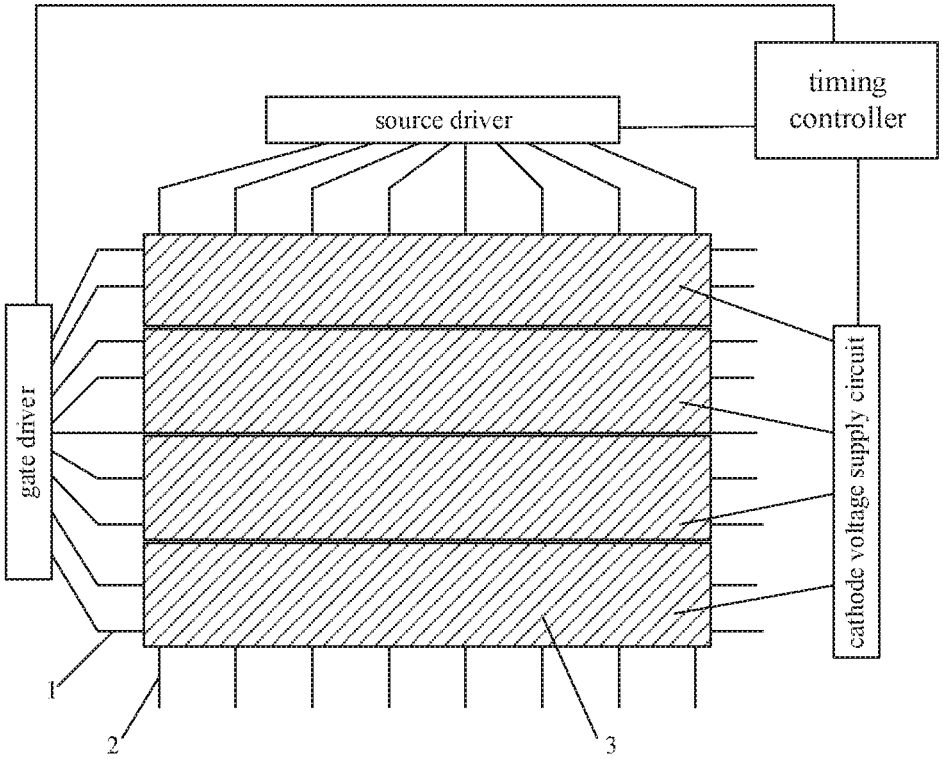
FIG. 1 illustrates a schematic structural diagram of an OLED panel according to an embodiment of the present disclosure.

FIG. 1 illustrates a schematic structural diagram of an OLED panel according to an embodiment of the present disclosure.

Embodiments of the present disclosure provide an OLED panel having a plurality of pixel units arranged in multiple rows and multiple columns. Each pixel unit includes an OLED device. The OLED panel includes a plurality of regions arranged in a column direction, each region includes at least one row of pixel units and has a cathode layer, the OLED devices in each region share the cathode layer in the region, and the cathode layer of each region is disconnected from the cathode layers of any other region. The OLED panel includes a cathode voltage supply circuit configured to output a cathode voltage including an operating level to the cathode layer of each region. The cathode voltage supply circuit is configured to start outputting the operating level to the cathode layer of at least one region at a time at least later than a time when all pixel units in the region receive a scan signal.

In some embodiments, as shown in FIG. 1, the OLED panel further includes a plurality of gate lines 1 and a plurality of data lines 2. The plurality of gate lines 1 and the plurality of data lines 2 intersect with each other to define the plurality of pixel units. As shown in FIG. 1, the plurality of gate lines 1 may extend in a row direction, and the plurality of data lines 2 may extend in a column direction. Each pixel unit includes an OLED device, and each OLED device includes a cathode, an anode, and a light-emitting layer between the cathode and the anode. In some embodiments, as shown in FIG. 1, the OLED panel includes a plurality of regions arranged in the column direction, each region includes at least one row of pixel units and has a cathode layer 3, the OLED devices in each region share the cathode layer 3 of the region as respective cathodes, and the cathode layers 3 of the respective regions are disconnected from each other. In some embodiments, as shown in FIG. 1, the OLED panel includes not only a gate driver for supplying a scan signal to the gate lines 1 and a source driver for supplying data signals to the data lines 2, but also a cathode voltage supply circuit and a timing controller. In some embodiments, the timing controller is configured such that a time when the cathode voltage supply circuit starts outputting an operating level to the cathode layer 3 of each region is at least later than a time when the gate driver finishes outputting the scan signal to all the gate lines 1 corresponding to the region.

In some embodiments, the number of the plurality of regions is N (N is an integer greater than or equal to 2), the cathode layers 3 of the N regions sequentially arranged in the column direction are a first cathode layer, a second cathode layer, . . . , a N-th cathode layer, and the cathode layer 3 of each region corresponds to, for example, 640 gate lines 1. Taking the example of outputting the operating level to the first cathode layer, the cathode voltage supply circuit is configured to: at least after the gate driver finishes outputting the scan signal to 640 gate lines 1 corresponding to the first cathode layer, start outputting the operating level to the first cathode layer, so that the OLED devices start emitting light; and output the operating level to the second cathode layer to the N-th cathode layer in the same way, thereby completing the display of one frame of picture. During the display period of one frame of picture, for each region, a time period for displaying a black picture, that is, a time period for not outputting the operating level to any cathode layer 3, exists so that the time for actually displaying each frame of picture is shortened, thereby alleviating the smear phenomenon of the OLED panel.

Figure 2:
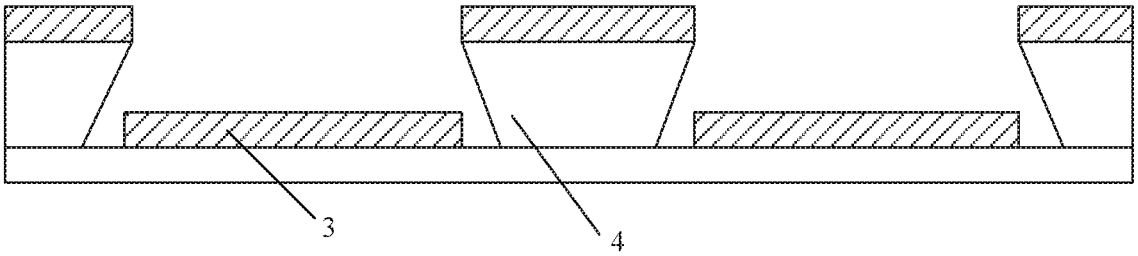
FIG. 2 illustrates a cross-sectional view of a cathode layer of an OLED panel according to an embodiment of the present disclosure.

Embodiments of the present disclosure provide a method of forming a plurality of cathode layers 3 corresponding to a plurality of regions of an OLED panel. The method of forming the plurality of cathode layers 3 includes the following steps: sequentially forming a buffer layer, a polycrystalline silicon layer, a gate insulating layer, a gate metal layer (including a gate electrode and the gate line 1), an interlayer insulating layer, a source/drain metal layer (including a source electrode, a drain electrode and the data line 2), a resin layer, an anode layer, a pixel defining layer and a light-emitting layer on a substrate; then, performing coating, exposing, developing and the like of photoresist on the substrate to form an inverted trapezoid structure 4 on the pixel defining layer between two adjacent regions; then, depositing a cathode material layer on the substrate with the inverted trapezoid structure 4 formed thereon to form the cathode layers 3. Due to the presence of the inverted trapezoid structure 4, the cathode material layer may naturally break and separate at the edges of the inverted trapezoid structure 4, thereby forming a plurality of cathode layers 3 corresponding to the plurality of regions of the OLED panel, as shown in FIG. 2.

In some embodiments, a signal line connecting the cathode layer 3 and the cathode voltage supply circuit may be a wire formed in synchronization with the anode layer, and the cathode layer 3 and the wire are electrically coupled to each other through a via hole in an insulating layer located therebetween.

In some embodiments, the OLED panel further includes: a dynamic portion determining circuit, a rate determining circuit, and an adjusting circuit. The dynamic portion determining circuit is configured to determine a region of the OLED panel for displaying a dynamic portion of a dynamic picture. The rate determining circuit is configured to determine a change rate of the dynamic portion. The adjusting circuit is configured to, in response to the rate determining circuit determining that a change rate of the dynamic portion is greater than a preset value, adjust a length of time for which the cathode voltage supply circuit outputs the operating level to the cathode layer 3 of the region for displaying the dynamic portion, to adjust a duty ratio of the cathode voltage. In some embodiments, the adjusting circuit is further configured to adjust magnitudes of data signals output to the pixel units in the region for displaying the dynamic portion, in response to the rate determining circuit determining that the change rate of the dynamic portion is greater than the preset value. In some embodiments, the adjusting circuit may adjust, by controlling the source driver, the magnitudes of the data signals output to the data lines 2 corresponding to the pixel units in the region for displaying the dynamic portion.

In the OLED panel according to the embodiment of the present disclosure, the dynamic portion determining circuit may determine a region of the OLED panel for displaying a dynamic portion in a dynamic picture; the rate determining circuit may determine a change rate of the dynamic portion; and when the change rate is greater than the preset value, the adjusting circuit may adjust a length of time of outputting the operating level to the cathode layer 3 of the region for displaying the dynamic portion, that is, adjust a duty ratio of the cathode voltage output to the cathode layer 3 of the region for displaying the dynamic portion. In some embodiments, the faster the dynamic portion changes, the longer the time of outputting the operating level to the cathode layer 3 of the region for displaying the dynamic portion is, and in this way, the picture smear can be effectively alleviated. At the same time, the data signals output to the data lines 2 corresponding to the pixel units in the region for displaying the dynamic portion may be adjusted to prevent the display luminance of the picture from being lowered after the duty ratio of the cathode voltage output to the cathode layer 3 is adjusted.

In some embodiments, the timing controller may be further configured to control the cathode voltage supply circuit such that a time at which the cathode voltage supply circuit starts outputting the operating level to the cathode layer 3 of each region is different from a time at which the cathode voltage supply circuit starts outputting the operating level to the cathode layer 3 of any other region. That is, the time at which the OLED device in each region is lit up is different. In some embodiments, the timing controller may further control the cathode voltage supply circuit such that a length of time for which the cathode voltage supply circuit outputs the operating level to the cathode layer 3 of each region is different from a length of time for which the cathode voltage supply circuit outputs the operating level output to the cathode layer 3 of any other region. In some embodiments, the timing controller may control the length of time for which the cathode voltage supply circuit outputs the operating level to each cathode layer 3 based on the region for displaying the dynamic portion determined by the dynamic portion determining circuit. In some embodiments, the length of time of outputting the operating level to the cathode layer 3 of the region for displaying more dynamic portions may be longer, so that the problem of dynamic picture smear can be effectively alleviated.

Embodiments of the present disclosure further provide a method for driving the above-described OLED panel. The method of driving the OLED panel may include: during a display period of one frame of picture, sequentially supplying a scan signal to a plurality of rows of pixel units in a column direction, while separately supplying, by the cathode voltage supply circuit, the cathode voltage including the operating level to the cathode layer of each of the plurality of regions. In some embodiments, in the method of driving the OLED panel, a gate driver inputs a scan signal to the gate lines 1 in each region, and a timing controller controls the cathode voltage supply circuit such that the cathode voltage supply circuit outputs the operating level to the cathode layer 3 of the region, so that OLED devices in the region emit light; and, the timing controller controls the cathode voltage supply circuit such that the time when the cathode voltage supply circuit starts outputting the operating level to the cathode layer 3 of each region is at least later than the time when the gate driver finishes outputting the scan signal to all the gate lines 1 corresponding to the region.

In some embodiments, the number of the plurality of regions is N (N is an integer greater than or equal to 2), the cathode layers 3 of the N regions sequentially arranged in the column direction are a first cathode layer, a second cathode layer, . . . , and a N-th cathode layer, and the cathode layer 3 of each region corresponds to, for example, 640 gate lines 1. Taking the example of outputting the operating level to the first cathode layer, at least after the gate driver finishes outputting the scan signal to the 640 gate lines 1 corresponding to the first cathode layer, the cathode voltage supply circuit starts outputting the operating level to the first cathode layer, so that the OLED devices start emitting light; and the cathode voltage supply circuit outputs the operating level to the second cathode layer to the N-th cathode layer in the same way, to complete the display of one frame of picture. During the display period of one frame of picture, for each region, a time period for displaying a black picture, that is, a time period for not outputting an operating level to any cathode layer 3, exists so that the time for actually displaying each frame of picture is shortened, thereby alleviating the smear phenomenon of the OLED panel.

Figure 3:
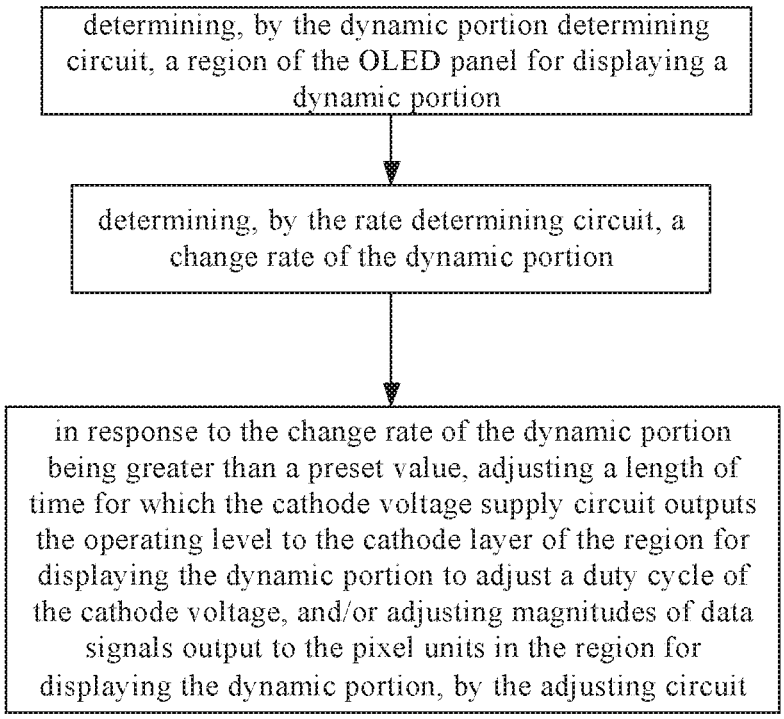
FIG. 3 illustrates a flow chart of a method of driving an OLED panel according to an embodiment of the present disclosure.

When the dynamic portion determining circuit, the rate determining circuit, and the adjusting circuit are provided in the OLED panel, as shown in FIG. 3, the method of driving the OLED panel according to the embodiment of the present disclosure may further include: determining, by the dynamic portion determining circuit, a region of the OLED panel for displaying a dynamic portion of a dynamic picture; determining, by the rate determining circuit, a change rate of the dynamic portion; when the rate determining circuit determines that the change rate of the dynamic portion is greater than a preset value, that is, the dynamic portion is a dynamic portion which changes at a high rate, adjusting, by the adjusting circuit, the length of time for which the cathode voltage supply circuit outputs the operating level to the cathode layer 3 of the region for displaying the dynamic portion, so as to adjust the duty ratio of the cathode voltage. In some embodiments, the method of driving the OLED panel according to embodiments of the present disclosure may further include: when the rate determining circuit determines that the change rate of the dynamic portion is greater than the preset value, adjusting, by the adjusting circuit, the magnitudes of the data signals output to the pixel units in the region for displaying the dynamic portion. In some embodiments, the magnitudes of the data signals output by the source driver to the data lines 2 corresponding to the region for displaying the dynamic portion may be adjusted by the adjusting circuit. In some embodiments, the adjusting circuit may not perform the adjustment if it is determined that the change rate of the dynamic portion is not greater than the preset value.

In the method of driving the OLED panel according to an embodiment of the present disclosure, a region of the OLED panel for displaying a dynamic portion of a dynamic picture may be determined by the dynamic portion determining circuit; a change rate of the dynamic portion may then be determined by the rate determining circuit; and when the change rate is greater than the preset value, the length of time for which the cathode voltage supply circuit outputs the operating level output to the cathode layer 3 of the region for displaying the dynamic portion, that is, the duty ratio of the cathode voltage output to the cathode layer 3 of the region for displaying the dynamic portion, may be adjusted by the adjusting circuit. In some embodiments, the faster the dynamic portion changes, the longer the time of outputting the operating level to the cathode layer 3 of the region for displaying the dynamic portion is, and as a result, the problem of picture smear can be effectively alleviated. At the same time, the data signals output to the data lines 2 corresponding to the pixel units in the region for displaying the dynamic portion may be adjusted to prevent the display luminance of the picture from being lowered after the duty ratio of the cathode voltage output to the cathode layer 3 is adjusted.

In some embodiments, the timing controller further controls the cathode voltage supply circuit such that a time at which the cathode voltage supply circuit starts outputting the operating level to the cathode layer 3 of each region is different from a time at which the cathode voltage supply circuit starts outputting the operating level to the cathode layer 3 of any other region. That is, the time when the OLED devices in the respective regions are lit up is different. In some embodiments, the timing controller further controls the cathode voltage supply circuit such that a length of time for which the cathode voltage supply circuit outputs the operating level to the cathode layer 3 of each region is different from a length of time for which the cathode voltage supply circuit outputs the operating level to the cathode layer 3 of any other region. In some embodiments, the timing controller may control the length of time for which the cathode voltage supply circuit outputs the operating level to each cathode layer 3 based on the region for displaying the dynamic portion determined by the dynamic portion determining circuit. In some embodiments, the length of time of outputting the operating level to the cathode layer 3 of the region for displaying more dynamic portions may be longer, so that the problem of dynamic picture smear can be effectively alleviated.

In some embodiments, the OLED panel includes four regions, each including 640 gate lines. In this case, the four regions of the OLED panel include 2560 gate lines (gate line Gate1 to gate line Gate2560) in total. A first region includes gate line Gate1 to gate line Gate640, a second region includes gate line Gate641 to gate line Gate1280, a third region includes gate line Gate1281 to gate line Gate1920, and a fourth region includes gate line Gate1921 to gate line Gate 2560. The method of driving the OLED panel according to an embodiment of the present disclosure will be described below, by taking an example that a duty ratio of a cathode voltage is 50%, which means that in a half of a display period of one frame of picture, an operating level is supplied to a cathode layer, and in the other half of the display period, a non-operating level is supplied to the cathode layer. In some embodiments, the cathode voltage output by the cathode voltage supply circuit to the cathode layer 3 includes an operating level and a non-operating level, the operating level is a low level voltage and the non-operating level is a high level voltage. When the cathode voltage supply circuit outputs a high level voltage to the cathode layer 3, the corresponding OLED device does not emit light.

Figure 4:
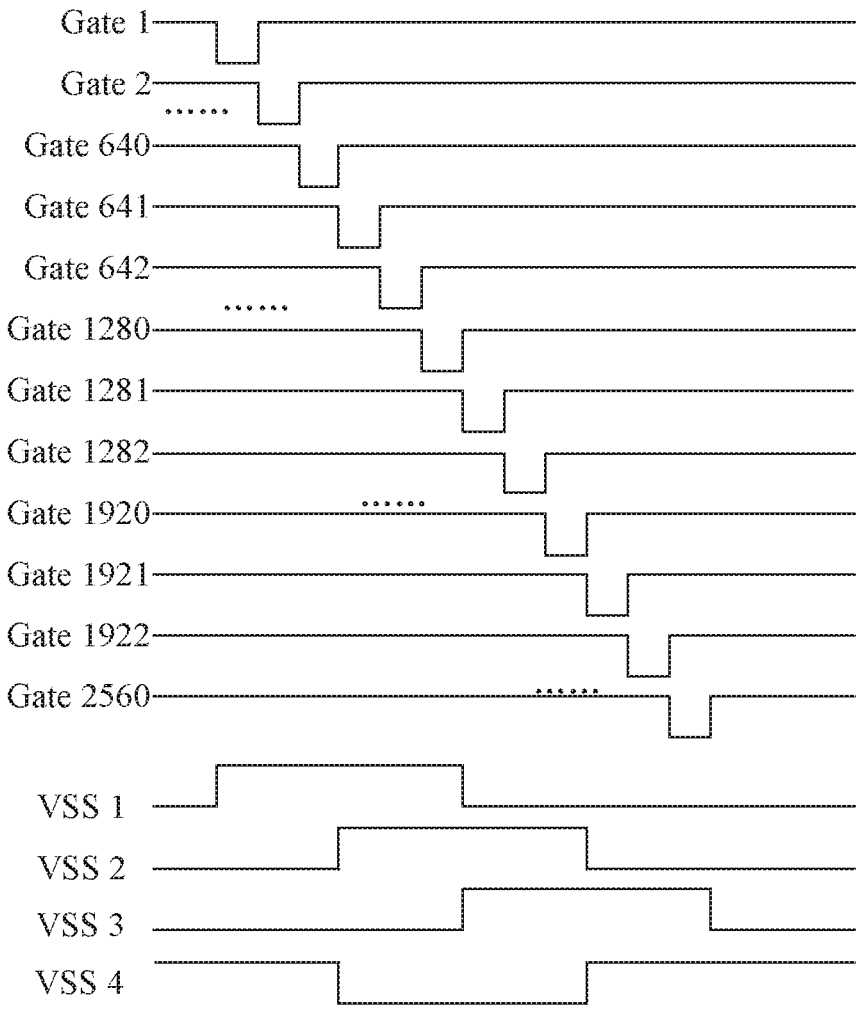
FIG. 4 illustrates a timing diagram of a method of driving an OLED panel according to an embodiment of the present disclosure.

As shown in FIG. 4, during a time period in which the gate driver outputs the scan signal to scan the pixel units row by row, during a display period of one frame of picture, at the same time when the gate driver starts outputting the scan signal (low level) to the gate line Gate1, the cathode voltage supply circuit starts outputting the non-operating level to the cathode layer of the first region, i.e., the cathode layer of the first region starts receiving a first cathode voltage VSS1 at a high level; then, at the same time when the gate driver finishes outputting the scan signal to the gate line Gate1280 (or after the gate driver finishes outputting the scan signal to the gate line Gate640), the cathode voltage supply circuit starts outputting the operating level to the cathode layer of the first region, that is, the cathode layer of the first region starts receiving the first cathode voltage VSS1 at a low level. As shown in FIG. 4, during the period of outputting the scan signal to the gate line Gate1 to gate line Gate1280, the cathode voltage supply circuit outputs the non-operating level to the cathode layer of the first region, and the first region of the OLED panel displays a black picture; during the period of outputting the scan signal to the gate line Gate1281 to gate line Gate2560, the cathode voltage supply circuit outputs the operating level to the cathode layer of the first region, and the first region of the OLED panel normally displays the picture. Therefore, the duty ratio of the first cathode voltage VSS1 is 50%. Similarly, the second cathode voltage VSS2 output to the cathode layer 3 of the second region is at a non-operating level during the period when the gate driver outputs the scan signal to the gate line Gate641 to gate line Gate 1920, and is at an operating level during the period when the gate driver outputs the scan signal to the gate line Gate1921 to gate line Gate2560 and the gate line Gate1 to gate line Gate640. In this case, the duty ratio of the second cathode voltage VSS2 is 50%. Similarly, the duty ratios of the third cathode voltage VSS3 and the fourth cathode voltage VSS4 are both 50%.

It should be understood that an example that the cathode voltage has a duty cycle of 50% is described above, but the present disclosure is not limited thereto. That is, the duty cycle of the cathode voltage of each cathode layer 3 is not limited to 50%, and may be higher or lower. It should be understood that the degree of picture smear may also change as the duty cycle of the cathode voltage is changed. In some embodiments, the duty cycle of the cathode voltage is in the range of 10% to 80%.

In the embodiment of the present disclosure, the OLED panel is divided into four regions, but the present disclosure is not limited thereto. That is, the OLED panel may include more regions or less regions, and the number of regions primarily decides the uniformity of the picture smear. The greater the number of regions, the better the uniformity of the picture smear. However, considering that the number of wirings on the periphery of the OLED panel should not be too large to affect the bezel width of the display screen, the number of regions of the OLED panel may range from 2 to 16 in some embodiments.

Embodiments of the present disclosure further provide a display device, which includes the above OLED panel, so the smear problem of a dynamic picture can be effectively alleviated.

The display device in the embodiments of the present disclosure is particularly applicable to near-eye display technology, i.e., virtual reality VR display devices, which have low luminance requirements but are so sensitive to smear and delay that slight picture smear and delay can cause noticeable glare and uncomfortable experience to a user of a head-mounted display.

Embodiments of the present disclosure further provide an apparatus, including: at least one processor; and a memory for storing at least one program. The at least one program, when executed by the at least one processor, causes the at least one processor to perform the aforementioned method of driving the OLED panel, and causes the at least one processor to function as the aforementioned timing controller, dynamic portion determining circuit, rate determining circuit, and adjusting circuit.

It could be understood that the above embodiments are merely exemplary embodiments adopted for describing the principle of the present disclosure, but the present disclosure is not limited thereto. Various variations and improvements may be made by those of ordinary skill in the art without departing from the spirit and essence of the present disclosure, and these variations and improvements shall also be regarded as falling into the protection scope of the present disclosure.

The invention claimed is:

1. An OLED panel, having a plurality of pixel units arranged in rows and columns, each pixel unit comprising an OLED device, wherein the OLED panel comprises a plurality of regions arranged in a column direction, each region comprises at least one row of pixel units and has a cathode layer, the OLED devices in each region share the cathode layer in the region, the cathode layer of each region is disconnected from the cathode layer of any other region;

the OLED panel comprises a cathode voltage supply circuit configured to output a cathode voltage comprising an operating level to the cathode layer;

the cathode voltage supply circuit is configured to start outputting the operating level to the cathode layer of at least one region at a time at least later than a time when all pixel units in the region receive a scan signal, and the cathode voltage supply circuit is configured to start outputting the operating level to the cathode layer in each region at a time different from a time at which the cathode voltage supply circuit starts outputting the operating level to the cathode layer in any other region.

2. The OLED panel of claim 1, further comprising a processor configured to:

determine a region of the OLED panel for displaying a dynamically changing portion of a dynamic picture;

determine a change rate of the dynamically changing portion; and in response to determining that the change rate of the dynamically changing portion is greater than a threshold, adjust at least one of: a length of time for which the cathode voltage supply circuit outputs the operating level to the cathode layer of the region for displaying the dynamically changing portion; and magnitudes of data signals output to the pixel units in the region for displaying the dynamically changing portion.

3. The OLED panel of claim 2, wherein the greater the determined change rate of the dynamically changing portion is, the longer the length of time for which the cathode voltage supply circuit outputs the operating level to the cathode layer of the region for displaying the dynamically changing portion is.

4. The OLED panel of claim 1, wherein the cathode voltage supply circuit is configured to output the operating level to the cathode layer of each region for a length of time different from a length of time for which the cathode voltage supply circuit outputs the operating level to the cathode layer of any other region.

5. The OLED panel of claim 4, wherein the cathode voltage supply circuit is configured to output the operating level to the cathode layer of a region for displaying more dynamically changing portions for a longer length of time.

6. The OLED panel of claim 1, wherein the cathode voltage supply circuit is configured to start outputting the operating level to the cathode layer of each region at a time at least later than a time when all the pixel units in the region receive the scan signal.

7. The OLED panel of claim 1, wherein a duty cycle of the cathode voltage is in a range of 10% to 80%.

8. A method of driving an OLED panel, the OLED panel having a plurality of pixel units arranged in rows and columns, each pixel unit comprising an OLED device, wherein the OLED panel comprises a plurality of regions arranged in a column direction, each region comprises at least one row of pixel units and has a cathode layer, the OLED devices in each region share the cathode layer in the region, the cathode layer of each region is disconnected from the cathode layer of any other region; the OLED panel comprises a cathode voltage supply circuit, the method comprises: during a display period of one frame of picture, sequentially supplying a scan signal to a plurality of rows of pixel units in a column direction, while separately supplying a cathode voltage comprising an operating level to the cathode layer of each of the plurality of regions by the cathode voltage supply circuit, wherein the cathode voltage supply circuit starts outputting the operating level to the cathode layer of at least one region at a time at least later than a time when all pixel units in the region receive the scan signal, and the cathode voltage supply circuit is configured to start outputting the operating level to the cathode layer in each region at a time different from a time at which the cathode voltage supply circuit starts outputting the operating level to the cathode layer in any other region.

9. The method of claim 8, further comprising, by a processor:

determining a region of the OLED panel for displaying a dynamically changing portion of a dynamic picture;

determining a change rate of the dynamically changing portion; and in response to determining that the change rate of the dynamically changing portion is greater than a threshold, adjusting at least one of: a length of time for which the cathode voltage supply circuit outputs the operating level to the cathode layer of the region for displaying the dynamically changing portion; and magnitudes of data signals output to the pixel units in the region for displaying the dynamically changing portion.

10. The method of claim 9, wherein the greater the determined change rate of the dynamically changing portion is, the longer the length of time for which the cathode voltage supply circuit outputs the operating level to the cathode layer of the region for displaying the dynamically changing portion is.

11. The method of claim 8, wherein the cathode voltage supply circuit outputs the operating level to the cathode layer of each region for a length of time different from a length of time for which the cathode voltage supply circuit outputs the operating level to the cathode layer of any other region.

12. The method of claim 11, wherein the operating level is output to the cathode layer of a region for displaying more dynamically changing portions for a longer length of time.

13. The method of claim 8, wherein the cathode voltage supply circuit is configured to start outputting the operating level to the cathode layer of each region at a time at least later than a time when all the pixel units in the region receive the scan signal.

14. The method of claim 8, wherein a duty cycle of the cathode voltage is in a range of 10% to 80%.

15. A display device, comprising the OLED panel of claim 1.

16. The display device of claim 15, wherein the display device comprises a virtual reality display device.

* * * * *